United States Patent [19]

Cox et al.

[11] 4,215,747

[45] Aug. 5, 1980

[54] BLOWOUT PREVENTER WITH TUBING ALIGNING APPARATUS

[75] Inventors: Fern H. Cox; William M. Taylor; Friedrich E. Just, all of Houston, Tex.

[73] Assignee: Cameron Iron Works, Inc., Houston, Tex.

[21] Appl. No.: 912,378

[22] Filed: Jun. 5, 1978

[51] Int. Cl.[2] ..... E21B 33/06

[52] U.S. Cl. ..... 166/85; 251/1 A; 277/11

[58] Field of Search ..... 277/11, 126, 127, 129; 251/1 R, 1 A; 166/54.1, 77.5, 85, 75 A; 285/137 A

[56] References Cited

U.S. PATENT DOCUMENTS

| | | | |
|---|---|---|---|
| 3,554,278 | 1/1971 | Reistle et al. | 166/85 |
| 3,955,622 | 5/1976 | Jones | 241/1 A X |
| 3,957,113 | 5/1976 | Jones et al. | 166/77.5 |

*Primary Examiner*—Martin P. Schwadron
*Assistant Examiner*—Richard Gerard
*Attorney, Agent, or Firm*—Vinson & Elkins

[57] ABSTRACT

A blowout preventer with an aligning apparatus having a housing with a vertical bore therethrough and a blowout preventer in one portion of the housing with guideways extending outward from the bore, aligning guideways in the housing spaced from and parallel to the blowout preventer guideways, an aligning ram in each of the aligning guideways with a piston for extending and retracting the aligning ram, each aligning ram having a carrier slidable in the aligning guideway with a cam surface and a jaw having a mating cam surface and mounted on the carrier with the respective cam surfaces being in engagement, the outer surface of the jaw being substantially perpendicular to the axis of the aligning guideways and adapted to engage tubing within the housing bore, the cam surfaces of opposing aligning rams being angled to cause the opposing jaws to move transversely in the aligning guideways when they come into engagement with tubing to cause the tubing to be moved with the jaws into the preferred position for closing the blowout preventer on the tubing.

4 Claims, 5 Drawing Figures

BLOWOUT PREVENTER WITH TUBING ALIGNING APPARATUS

BACKGROUND OF THE INVENTION

Difficulties have been encountered in subsea production wells having two tubing strings extending through the wellhead with the closing of a blowout preventer around such dual strings without crushing or damaging such strings because they cannot be oriented by sight.

One effort to solve this problem is shown in the Carl E. Reistle, III et al U.S. Pat. No. 3,554,278 issued Dec. 22, 1970. The device disclosed utilizes the configuration of the ram faces to bring the pipe strings into the desired position. Such face configurations include tapered side surfaces and grooves into which the strings are to be positioned when the rams are closed. One problem encountered with such a device is that if one string is directly behind the other, the strings may not be brought into proper position by this device. Another patent showing the use of alignment rams positioned at 90° to the blowout preventer rams is the Howard W. Jones U.S. Pat. No. 3,955,622 issued May 11, 1976.

A structure somewhat similar to the structure of the improved apparatus of the present invention is shown in the Marvin R. Jones et al U.S. Pat. No. 3,957,113 issued May 18, 1976 and discloses a dual ram structure to be used with a blowout preventer which engages a pipe section and causes it to rotate to unscrew the joints. The rotation is imparted by jaws with teeth engaging the pipe section and with cam surface engagement with its carrier so that as the rams close, the jaws move to the sides creating a moment couple on the pipe section.

SUMMARY

The present invention relates to an improved apparatus for aligning dual strings in a blowout preventer. The improved apparatus includes a pair of rams in opposed guideways of a blowout preventer housing, each of the rams including a carrier with a cam surface and a jaw with a mating cam surface mounted on the carrier, the cam surfaces being angled to cause the jaws to move to the sides on engaging pipes between the jaws to move dual pipes into preselected aligned position.

An object of the present invention is to provide an improved aligning apparatus for a dual string blowout preventer which assures that the strings are properly positioned for closing the blowout preventer.

Another object is to provide an improved aligning apparatus for a dual string blowout preventer which may be installed in a standard blowout preventer housing.

A further object is to provide an improved dual string blowout preventer which may be closed to control well pressure without fear of crushing the strings.

BRIEF DESCRIPTION OF THE DRAWINGS

These and other objects and advantages of the improved apparatus of the present invention are set forth and explained with reference to the drawings wherein.

DESCRIPTION OF THE PREFERRED EMBODIMENT

Figure 1:
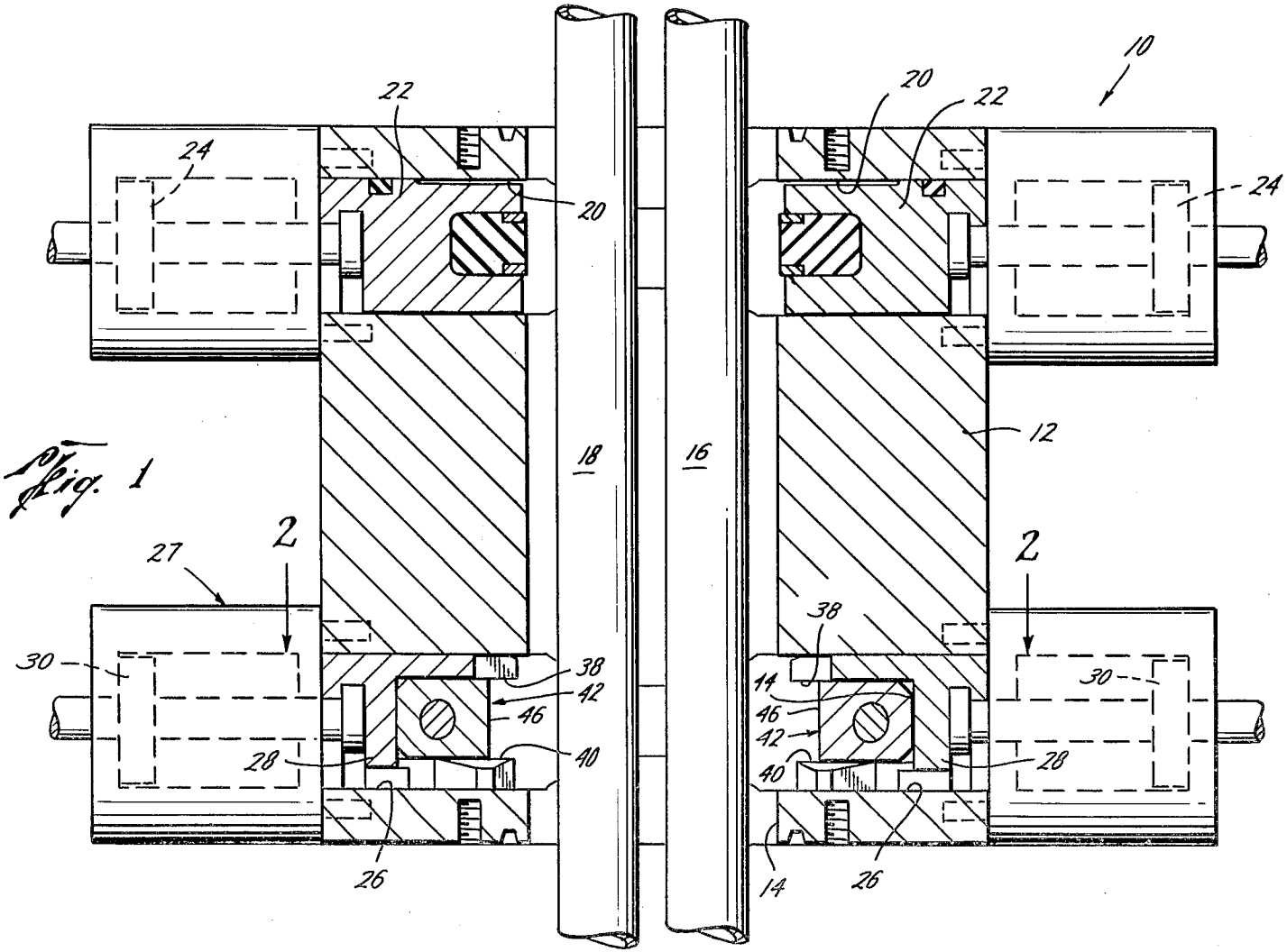
FIG. 1 is a sectional view of the improved dual string blowout preventer and aligning apparatus of the present invention.
Figure 5:
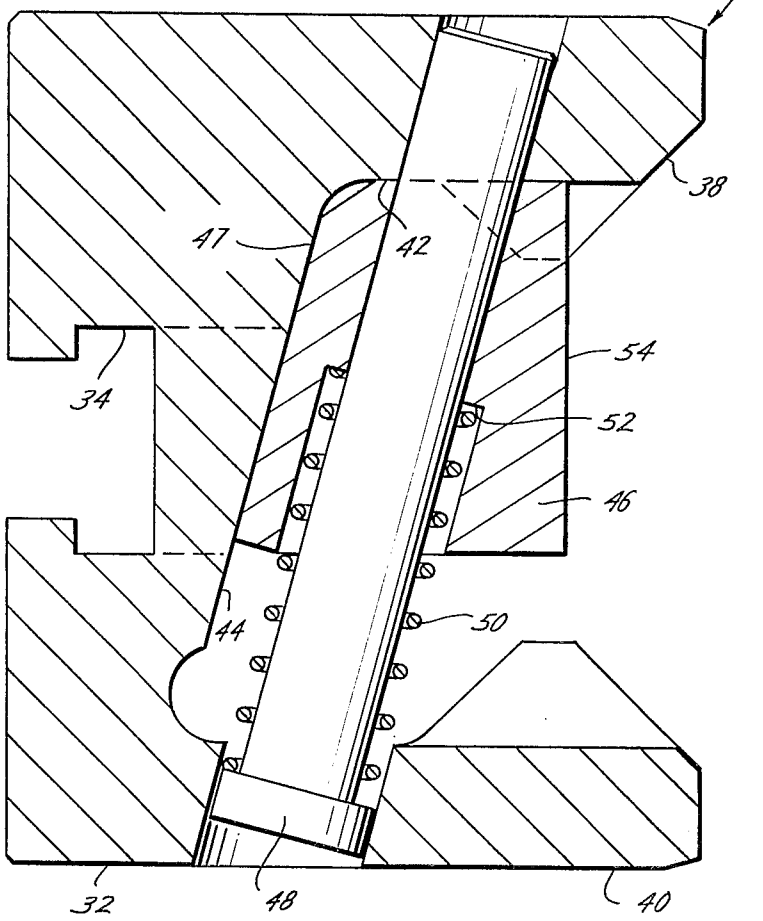
FIG. 5 is a sectional view of the the carrier and jaw of the aligning ram.

The improved dual string blowout preventer 10 of the present invention is shown in FIG. 1. It includes the housing 12 having the central bore 14 extending vertically therethrough. The dual tubing strings 16 and 18 are shown in FIGS. 1 to 4. The blowout preventer housing 12 also has opposed upper guideways 20 with rams 22 positioned therein and moved by pistons 24 to extended and retracted positions. While the rams 22 shown are sealing rams it should be understood that they may be shear rams. The housing 12 also includes the lower opposed aligning guideways 26 for the improved aligning apparatus 27.

The improved aligning apparatus includes the rams 28 positioned in the aligning guideways 26 and extended and retracted by the pistons 30. The rams 28 each include a carrier 32 which as shown in FIGS. 1 to 5 includes the rear slot 34 into which piston rod 36 connects, the upper and lower flanges 38 and 40 and the horizontal recess 42 therebetween. The back surface 44 of recess 42 is a cam surface which is at an angle with respect to the axis of guideways 26. As seen in plan view in FIGS. 2, 3 and 4, the flanges 38 and 40 extend forward at each side and taper back to cause the strings to be moved toward the central portions as shown in FIG. 4.

The jaw 46 is positioned in recess 42 with its cam surface 47 engaging the cam surface 44 of carrier 32 and mounted on pin 48 which extends across recess 42 parallel to cam surface 44. Spring 50 surrounds pin 48 and engages the shoulder 52 to urge the jaw 46 in the direction toward the most forward part of the cam surface 44. The outer or pipe engaging surface 54 of jaw 46 is generally flat and perpendicular to the axis of the aligning guideways 26. Surface 54 being generally flat without teeth or serrations when engaging a pipe causes the pipe to move transversely with the movement of jaw 46 without rotating the pipe.

Figure 2:
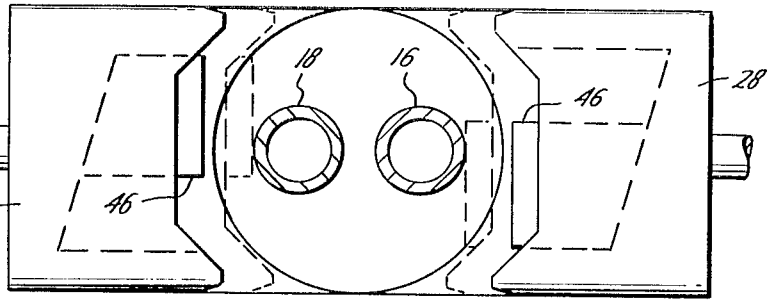
FIG. 2 is a sectional view taken along line 2—2 in FIG. 1 showing the retracted position of the aligning rams and the initial movement of the dual string by the rams in dashed lines.
Figure 3:
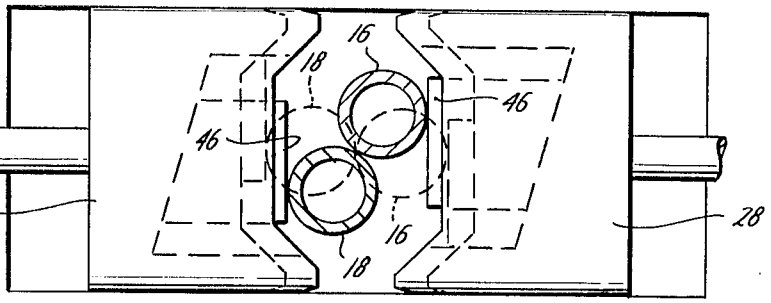
FIG. 3 is a similar view showing the initial engagement in dashed lines and the responsive movement of the ram jaws and the string movement in solid line.
Figure 4:
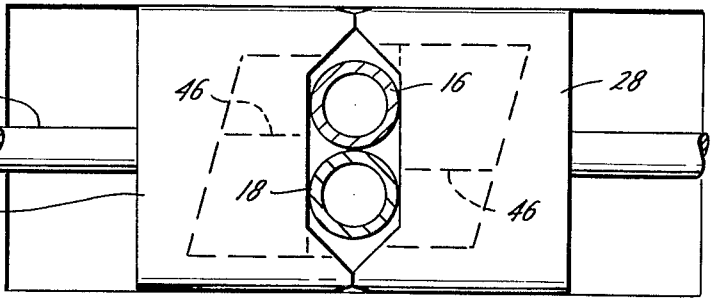
FIG. 4 is another similar sectional view showing the closed positions of the aligning rams.

The function of the aligning apparatus 27 is to assure that the strings 16 and 18 are properly and quickly positioned so that the rams 22 may be closed without any possibility of damaging them as illustrated schematically in FIGS. 2, 3 and 4.

In FIG. 2, the strings 16 and 18 are in the position of being aligned one behind the other with respect to rams 22 and rams 26. Closing of the blowout preventer rams 22 on the strings 16 and 18 in this position would most often result in damage to one or both of the strings. The rams 26 are shown in solid lines in FIG. 2 in their retracted position and in dashed lines in their extended position so that the outer surface 54 of the jaws 46 is in engagement with the strings 16 and 18.

This initial extended position is also shown in FIG. 3 in dashed lines. It should be noted that the jaws 46 in this extended position are still in their outermost position with respect to the cam surface 44 being urged to such position by the spring 50. Further inward movement of rams 28 is shown by the solid lines in FIG. 3. With this additional movement, the jaws 46 are caused to slide on the cam surfaces 44 and in doing this move the strings 16 and 18 transversely of the axis of the guideways 26.

Further movement of the rams 28 moves the strings 16 and 18 to their desired side-by-side position for the shutting of blowout preventer rams 22 as shown in FIG. 4. In this position, the side extensions of flanges 38 and 40 center the strings 16 and 18 as shown in FIG. 4.

The aligning of the strings 16 and 18 is illustrated in the drawings. The improved aligning apparatus properly and quickly positions the strings 16 and 18 independent of their position as the rams 28 start to close. When the strings 16 and 18 are not in the position shown in FIG. 2, the action of jaws 46 do not affect the aligning of the strings.

What is claimed is:

1. A blowout preventer with a pipe aligning apparatus for positioning a pair of pipes in a well bore for engagement by the blowout preventer, comprising a housing having a vertical bore therethrough, said housing having ram guideways perpendicular to and extending from said bore, rams in said guideways and having means for moving said rams inward and outward therein, said blowout preventer closing and sealing on the pair of pipes when a plane passing through the axes of the pipes is substantially perpendicular to the axis of the ram guideways, aligning guideways spaced from and parallel to said blowout preventer ram guideways, an aligning ram positioned in each of said aligning guideways and having means for being moved radially inward and outward of said housing bore, each aligning ram having, a carrier slidable in the aligning ram guideway, and having a cam surface facing said bore in a vertical plane at an angle to the axis of the aligning ram guideways, a flange extending forward into said bore on at least one side of said carrier and being tapered to urge pipes away from the sides of said bore, and a jaw movably mounted on said carrier and having a cam surface engaging the cam surface of said carrier and a surface facing said housing bore substantially parallel to the axis of said vertical bore, the cam surfaces of the opposing rams coacting so that when their jaws engage pipes within said housing bore in a position preventing closing of the blowout preventer, the jaws slide transversely of the associated guideway in substantially opposite directions whereby the pipes are brought into a position with their axes lying in a plane substantially perpendicular to the axis of the blowout preventer ram guideways to allow closing of and sealing by the blowout preventer.

2. A blowout preventer according to claim 1 wherein the surface of said jaw engaging a pipe in said bore has a surface which when engaging a pipe causes the pipe to move transversely of the bore without rotating the pipe.

3. For use with a blowout preventer adapted to close on a pair of pipes when positioned in a side-by-side relationship, an aligning apparatus comprising, a housing having a vertical bore therethrough, said housing having aligning ram guideways substantially perpendicular to and extending from said housing bore, an aligning ram positioned in each of said aligning guideways and having means for being moved radially inward and outward of said housing bore, each aligning ram having, a carrier slidable in the aligning ram guideway, and having a cam surface facing said bore and being in a vertical plane at an angle to the axis of the aligning ram guideway, flanges extending forward into said bore on at least one side of said carrier and being tapered to urge pipes away from the side of said bore, and a jaw movably mounted on said carrier and having a cam surface engaging the cam surface of said carrier and a surface facing said housing bore substantially perpendicular to the axis of said aligning ram guideway, the jaws of the opposing rams coacting with pipes in said bore whereby they are adapted to engage randomly disposed pipes within said housing bore and to slide transversely of the associated guideway in opposite directions to bring the pipes into a predetermined side-by-side position.

4. A pipe aligning apparatus according to claim 3 wherein the surfaces of said jaws engaging a pipe in said bore have a surface which when engaging a pipe causes the pipe to move transversely of the bore without rotating the pipe.

* * * * *